United States Patent [19]

Eckold et al.

[11] Patent Number: 4,835,850

[45] Date of Patent: Jun. 6, 1989

[54] APPARATUS FOR JOINING PIECES OF SHEET METAL

[76] Inventors: Gerd-Juergen Eckold, Silberhutte 11, D-3424 St., Andreasberg, Fed. Rep. of Germany; Hans Maass, Germelmannstr. 12, D-3422, Bad Lauterberg, Fed. Rep. of Germany

[21] Appl. No.: 124,585

[22] Filed: Nov. 24, 1987

[30] Foreign Application Priority Data

Nov. 29, 1986 [DE] Fed. Rep. of Germany ..... 3640896

[51] Int. Cl.[4] ..... B23P 11/00

[52] U.S. Cl. ..... 29/243.52; 29/509; 29/521; 29/524.1; 72/197

[58] Field of Search ..... 29/243.5, 243.52, 509, 29/521, 522 A; 72/186, 187, 197

[56] References Cited

U.S. PATENT DOCUMENTS

| | | | |
|---|---|---|---|
| 2,254,558 | 9/1941 | Williams | 29/432 X |
| 2,924,312 | 2/1960 | Williams | 29/509 |
| 3,579,809 | 5/1971 | Wolf | 29/509 |
| 3,993,428 | 11/1976 | Gumm et al. | 29/522 AX |
| 4,208,776 | 6/1980 | Schleicher | 29/243.5 |
| 4,459,735 | 7/1984 | Sawdon | 29/509 |
| 4,614,017 | 9/1986 | Eckold et al. | 29/798 |
| 4,658,502 | 4/1987 | Eckold et al. | 29/798 |

*Primary Examiner*—Timothy V. Eley
*Assistant Examiner*—Frances Chin
*Attorney, Agent, or Firm*—Cushman, Darby & Cushman

[57] ABSTRACT

An apparatus for joining two or more sheets by means of drawn and extruded material portions comprising a punch, a die and an anvil. The punch is driven to first cooperate with the die in a drawing step, then to transport the work piece to the anvil and to perform in cooperation with the latter an extrusion step. Preferably, a plurality of punches is driven to rotate and to cooperate with a die-and-anvil assembly common to all punches.

27 Claims, 7 Drawing Sheets

APPARATUS FOR JOINING PIECES OF SHEET METAL

FIELD OF INVENTION

This invention relates to apparatus for joining pieces of sheet metal together in a continuous manner by sequentially forming fastening means from integral portions of the material being fastened together at spaced apart locations along the sheet metal pieces.

DESCRIPTION OF THE PRIOR ART

An apparatus for joining together pieces of sheet metal in either a stationary or continuous manner is described in U.S. Pat. No. 2,254,558 to Williams. The Williams apparatus uses essentially two subassemblies that come to be driven against one another, a punch member and a combined die-and-anvil member. Generally, in the stationary approach two or more pieces of sheet metal are disposed on the combined die-and-anvil member in overlapping relation. A punch member is moved vertically into engagement with the sheets and in turn moves them toward and draws through portions thereof so that the drawn portion enters a cavity defined with the die-and-anvil member. The latter includes an anvil member, and as the through-drawn sheet material continues to move with the punch member the drawn sheet material is pressed between the punch and the anvil thereby laterally extruding the previously drawn sheets while simultaneously the cutting portions of the die member yield laterally. In this manner, part of the material being fastened together is formed into a fastening means.

Williams also discloses a continuous apparatus comprised a first wheel carrying a plurality of punches and a second wheel carrying a like plurality of the same die-and-anvil subassemblies. The two wheels are driven in synchronism to move the overlapped metal pieces and as the strips of sheet metal are fed into a position between the wheels, the succeeding mating of the tools each produce a joint. In practice, however, such an apparatus would require wheels of prohibitively large diameters because otherwise, the punches commence to cut through the sheets prior to the latter being fully supported by the lower die-anvil subassembly with resulting serious deformations of the sheets adjacent the joints.

A similar apparatus is shown in U.S. Pat. No. 3,993,428 to Gumm et al.; this apparatus suffers the same drawback.

SUMMARY OF THE PRESENT INVENTION

The present invention obviates these problems. Rather than employing the prior art combination of a die and anvil, the present invention employs a die member and an anvil member which are separate, spaced apart elements but which cooperate, respectively, in a novel manner with a series of punches mounted on a rotating wheel. Specifically, each punch member is initially used in a first station in combination with the separate die for drawing a portion of two overlapped pieces of sheet material and then at a second station in combination with the anvil, which is spaced from the die, for laterally extruding the previously drawn sheet material. Operation of the punch member relative to the separated die and anvil members is accomplished by driving each individual punch member along a path which includes a first force component in a direction required for performing a drawing and extruding and a second force component substantially orthogonal to the first component for transporting the overlapping sheet material from the first station to the second station.

Accordingly the present invention provides an apparatus for continuously producing joints of the type described above but without the drawbacks noted as characteristic of the state of the art.

In contrast thereto the material in the present invention is drawn at a first station at a point removed from the anvil. Because the die does not have an anvil associated with it the cutting portions of the die need not be flexible and the die member can be optimized to define the precise portion of the sheet metal to be cut and drawn. Similarly in the second station, the space available for the anvil is not limited by the cutting die portions so that the anvil, too, may be optimized as to its shape and strength. After having passed the first station the punch protrudes into the pieces of sheet metal which still encase the punch and are easily transported to the second station.

Further objects, features and advantages of the invention will become apparent from the following detailed description of embodiments thereof wherein the attached drawings are referred to.

DESCRIPTION OF THE PREFERRED EXEMPLARY EMBODIMENT

The apparatus according to the present invention is basically comprised of three individual elements, namely a punch, die and anvil, and all three elements may assume quite different forms without departing from the spirit of the invention as will be discussed hereunder.

Figure 1:
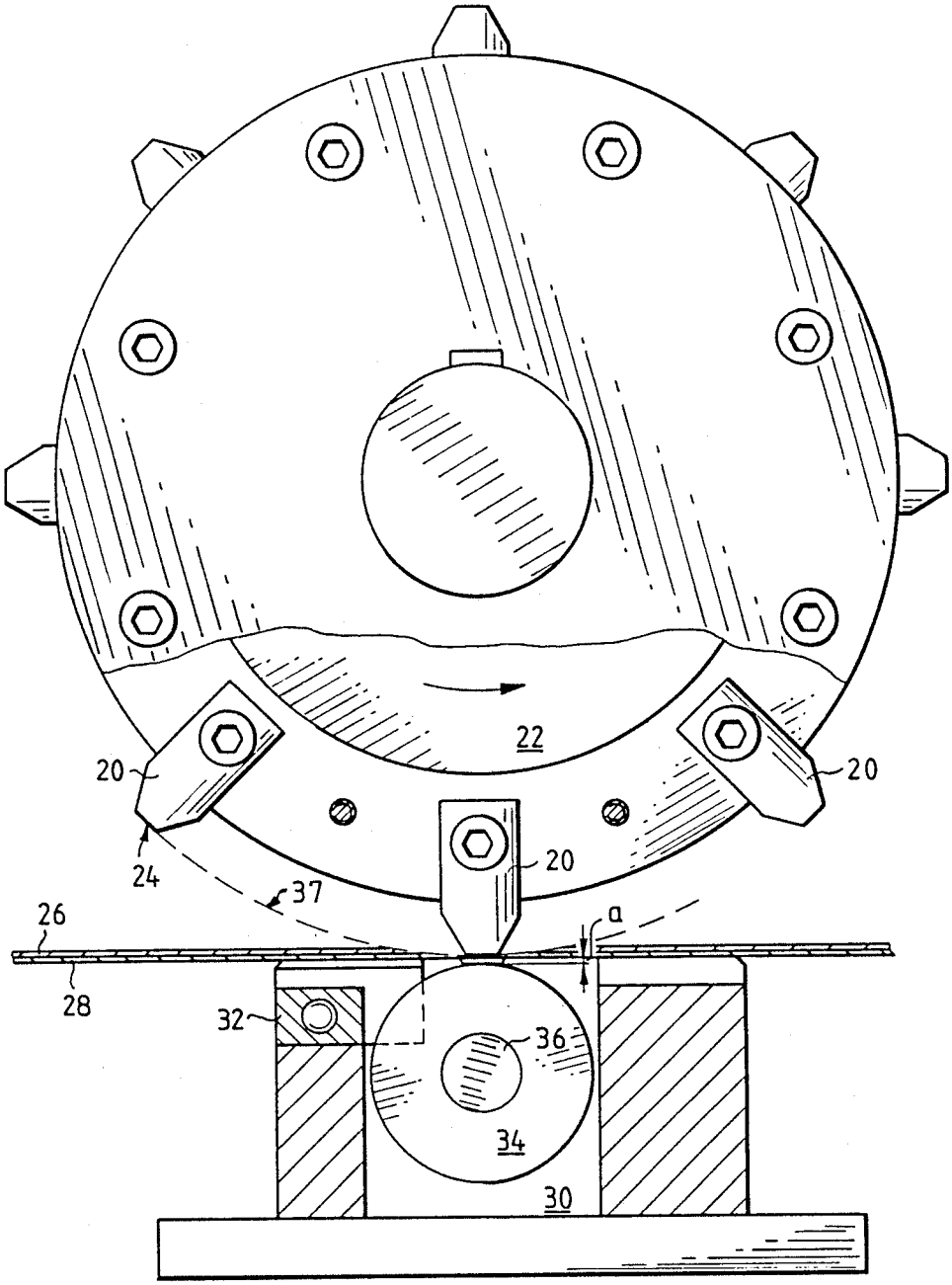
FIG. 1 illustrates schematically in section a first embodiment of the invention.

Referring first to FIG. 1, a plurality of punches 20 are equally spaced circumferentially about a punch wheel 22 which will be driven in a rotary manner as shown by the arrow. All punches 20 are of identical design and each includes a radially pointing working face 24 that is shaped, such as, for example in a rectangular or rounded manner. It should also be noted that punches 20 are removably attached to punch wheel 22 such as by bolts 23 or other conventional mounting techniques that would permit replacement.

Figure 2:
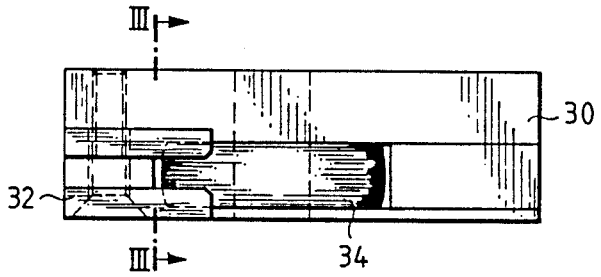
FIG. 2 is a plan view of the die-anvil-assembly in FIG. 1.
Figure 3:
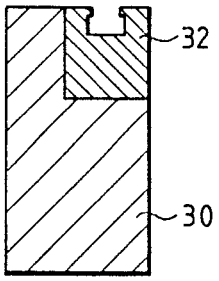
FIG. 3 is a front view of the die seen in direction 3-3 of FIG. 2.

Two overlapping sheet metal pieces 26, 28 are shown at a first position on the top face of a support 30 on which the die 32 and anvil 34 are mounted. With reference to FIGS. 1–3, die 32 is comprised of a block that is removably mounted to support 30 such as, for example, by a bolt 31. Die 32 can have a slot 100 machined or otherwise formed therein so as to define a generally U-shaped internal slot profile as shown in FIGS. 2 and 3. Slot 100 opens upwardly toward the punch wheel 22 and has a width at the respective ends of the die such that the slot defines edges that cooperate with the counter edges of each punch 20 to form a cut through sheets 26, 28.

As may be seen in FIG. 3, the die slot 100 tapers outwardly from the top cutting edges downwardly to the bottom of the slot.

In this embodiment, the anvil comprises roller 34 rotatably supported by pin 36 which is itself rotatably journalled in support 30. As may be seen in FIG. 2, roller 34 is located in alignment with the die slot 100 and the upper surface thereof is somewhat depressed with respect to the cutting edges of die 32. Roller 34 is markedly wider than the width of slot 100, and the upper face of the die 32 is closer to punch wheel 22 than is the circumference of roller 34 by a distance "a" as shown in FIG. 1, which distance is preferably adjustable.

The shaping of the contour of roller 34 affects the shape of the "rivet head" to be produced. In particular, the profile of roller 34 can be made such that the portion of the punched material stemming from the sheet adjacent die 32 is laterally supported thereby preventing its extrusion without, however, interfering with the extrusion of the material stemming from the other sheet or sheets remote from the die. In this manner, the joint can be made particularly strong.

The operation of the apparatus is as follows:

Sheets 26, 28 are displaced in a horizontal direction along the support 30 from the left side (as seen in the drawing) and along the upper die face until the sheets reach a point where the punch wheel 22, facing the top side of sheet 26, intersects the flight circle 37—indicated in dashed lines—of the working faces of punches 20. Punch wheel 22 as driven rotates in a counter clockwise direction. As one of the punches 20 intersects the sheets it will cut through both sheets 26, 28 to form two parallel slits in cooperation with stationary die 32 and in particular in cooperation with the two parallel cutting edges of that die. This cut will begin at the point of intersection mentioned above. Thereafter, the sheets are transported by the continued revolution of the punch because the material between the slits has been drawn into the die slot 100 and the sheets thus "cling" at or around the punch.

When the punch 20 and the sheets approach the anvil 34, which is spaced horizontally from die 32, the distance between the working face of the punch 20 and the anvil contour is less than the total of the sheet, thicknesses. Accordingly, as the drawn material moves horizontally under the driving force of the punch 20 and wheel 22 the drawn material is extruded laterally as the anvil roller 34 itself rotates through a small angle. The sheets 26, 28 continue to be transported by the punch 20 which continues to move as punch wheel 22 rotates until the punch 20 leaves the first joint so formed, and this is preferably at the instant when the next punch 20 commences to cut through the next portion of sheets 26 and 28 which then overlie die 32 to prepare the next joint.

The die and the anvil are preferably made of a material resisting wear and tear such as, for example, carbide metal. It will be recognized that the die as well as the anvil are quite rugged so that the apparatus is very reliable.

Figure 4:
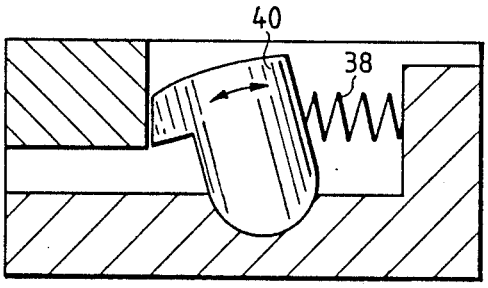
FIG. 4 shows a modified anvil design.

FIG. 4 illustrates an alternative anvil structure instead of roller 34, such as a tiltable lever 40 which is biased by spring 38 into its start position as shown.

Figure 5:
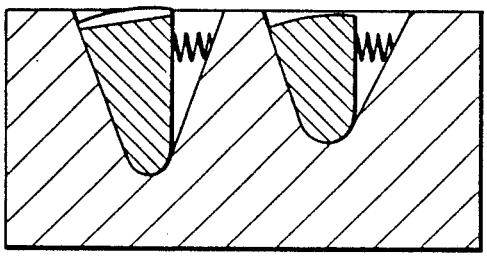
FIG. 5 illustrates in similar fashion to FIG. 1 another design of the die-anvil-assembly.

In order to reduce wear due to the relative motion between the die and the metal sheets, the die also can be a tiltable lever as illustrated at 102 in FIG. 5, biased by an appropriate spring into its start position while continuing to incorporate the necessary cutting edges. A cooperating anvil 104 is also shown.

Figure 6:
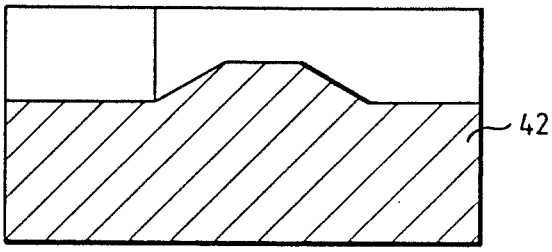
FIG. 6 shows yet another type of anvil.

On the other hand, it is also possible to tolerate frictional wear at the anvil, too, and for this purpose, the anvil can be simply a stationary plate 42 as shown in FIG. 6. The working face 106 of plate 42 would preferably be polished.

It will be appreciated that each of the illustrated die types may be combined with each of the illustrated anvil types.

Figure 7:
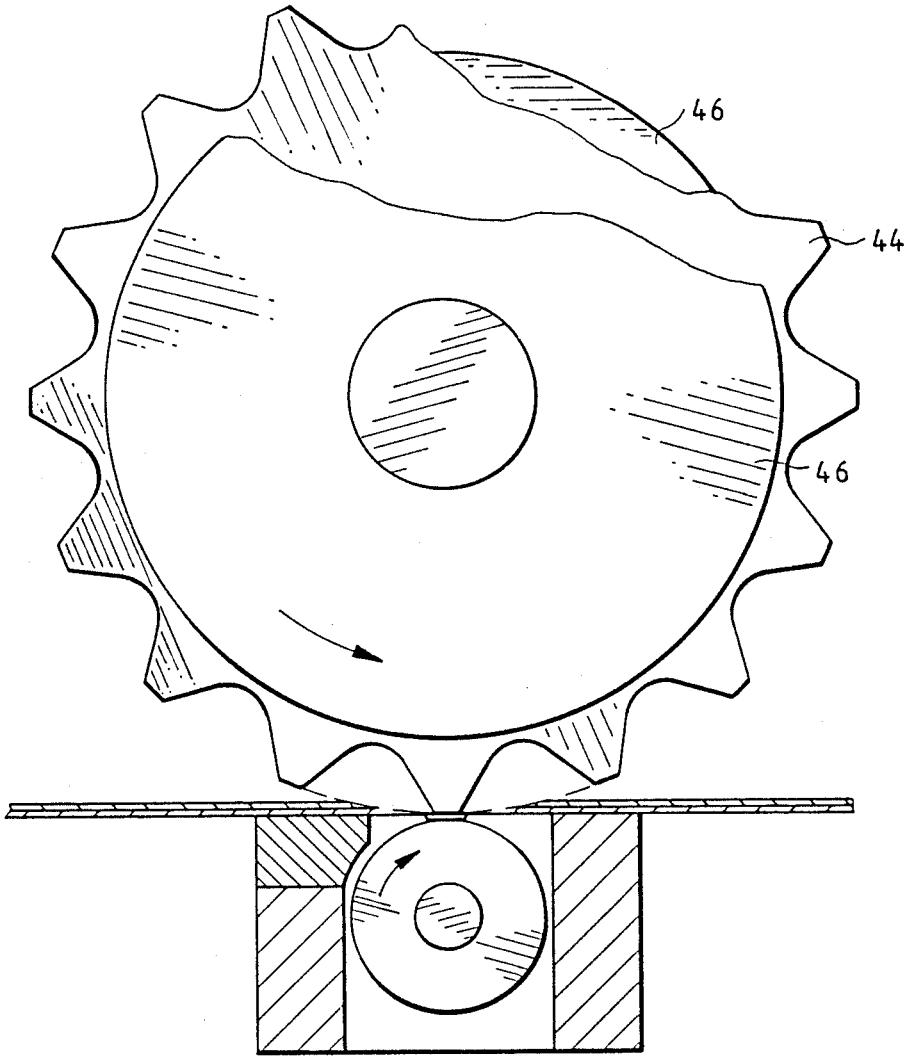
FIG. 7 shows a modified punch wheel.

Alternative embodiments for the punches and punch wheel, too, are within the concept of the present invention. While in the FIG. 1 embodiment individual punches 20' are releasably mounted on the wheel, in the FIG. 7 embodiment the punches and the wheel form an integral star-shaped member 44 which is stiffened, preferably bilaterally, by means of support disks 46.

Figure 8:
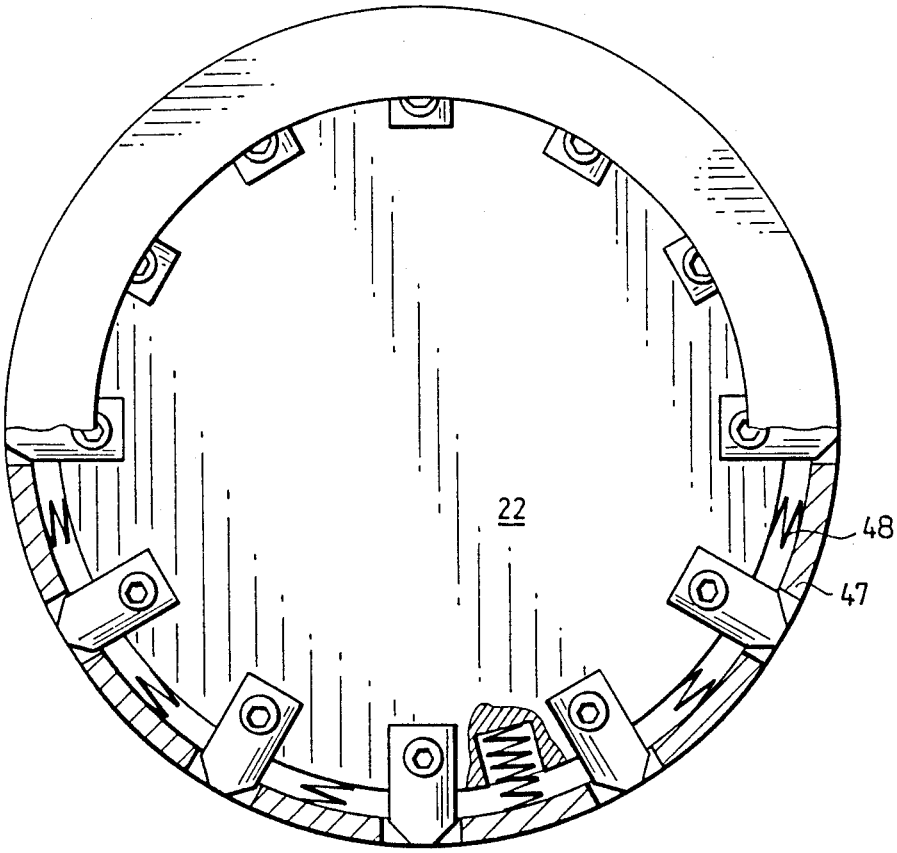
FIG. 8 shows a further modified punch wheel.
Figure 9:
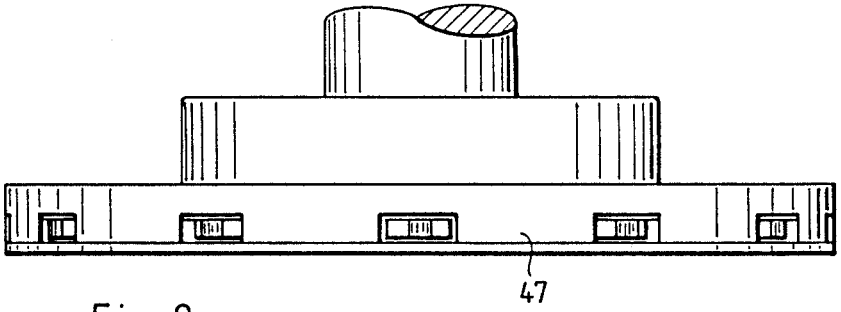
FIG. 9 is a partial view of the punch wheel of FIG. 8.

FIGS. 8 and 9 illustrate another embodiment wherein on a punch wheel 22 similar to that of FIG. 1, an ejector ring 47 is mounted thereover and is supported by springs 48. Ring 47 serves the purpose of pushing off the sheets after completion of the joint.

Yet another embodiment is conceivable wherein in lieu of a punch wheel only a sector of such wheel can be swung back and forth, and only a few or even only one punch is provided within such a sector.

Figure 10:
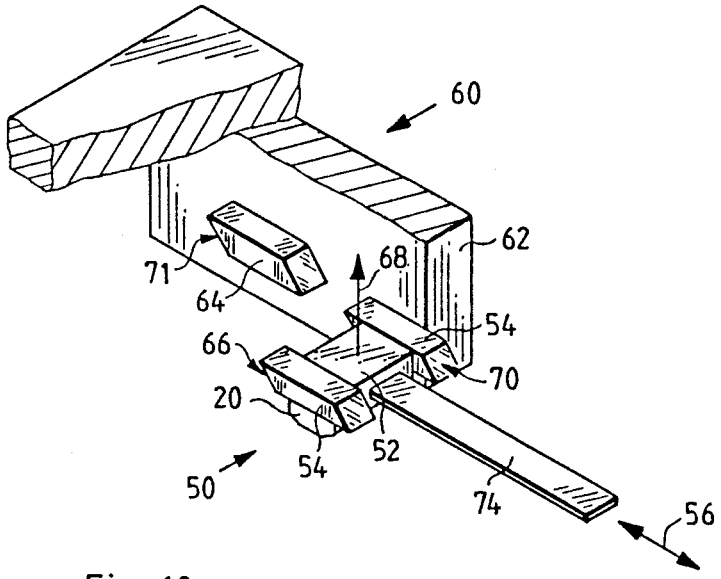
FIG. 10 shows schematically a modified punch assembly design.

Still another alternative embodiment is illustrated in FIG. 10. A punch assembly, generally indicated at 50, is comprised of a central block 52 and two lateral cam blocks 54 each of which carries one of two parallel punches (only one is shown in the drawing). The central block 52 is mounted, via a leaf spring 74, at a reciprocating drive means, e.g. the piston of a hydraulic cylinder symbolized by arrow 56. In this way, the punch assembly 50 may be reciprocated relative to a stationary cam housing 60. The walls 62 of the latter carry cam members 64. The sloping faces 66 thereof are contacted by the cam blocks 54 which re lifted in the direction of arrow 68 under deflection of leaf spring 74 until the blocks return to their normal position behind the cam members 64. Upon reversal of the drive means, the punch assembly is pressed into the sheets supported by the die (not illustrated in the drawing) because of the cooperating sloping surfaces 70 and 71 provided on the cam members 64 and cam blocks 54, respectively. Accordingly, the joint is formed while the punch assembly is retracted, and beyond the cam members, the punch assembly is lifted off the joint by leaf spring 74.

Figure 11:
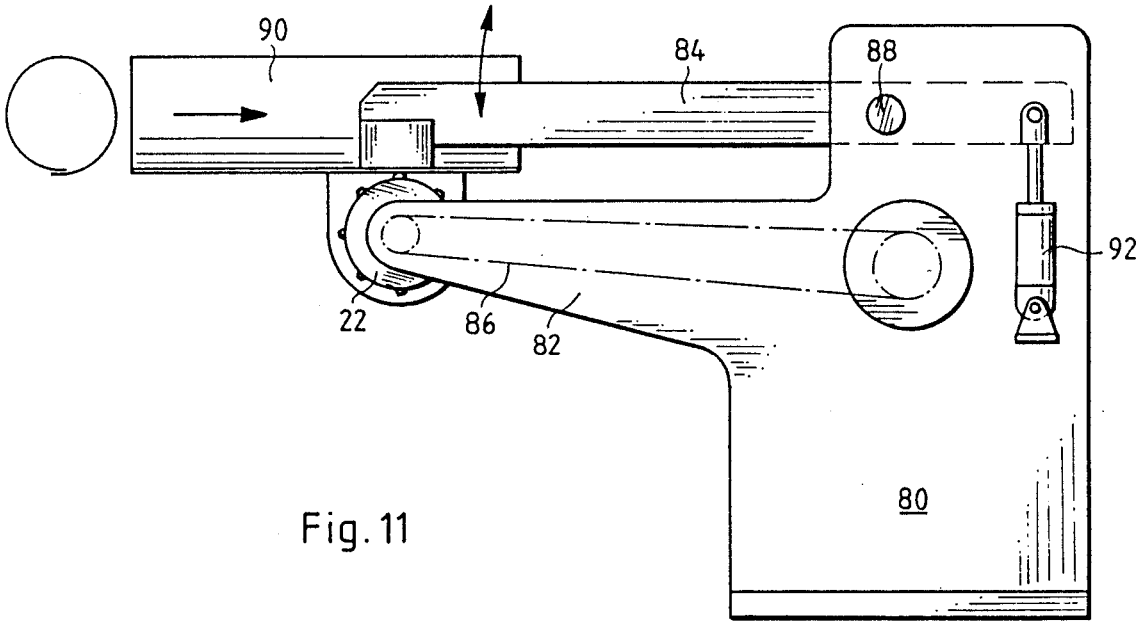
FIGS. 11 illustrate embodiments of equipment incorporating 12, 13 the present invention.

FIG. 11 schematically shows a machine incorporating the apparatus of the invention. The machine is intended to join together the overlapped longitudinal edges of tubularly bent sheets to form closed tubes therefrom. A base frame 80 contains the drive means the design of which is of no importance for the invention. A first cantilever 82 carries a punch wheel as described above, and a second cantilever 84 extending parallel to the first one carries the separated die and anvil members. Drive torque may be transmitted by means of a chain 86 or the like. The second cantilever is pivotable about a journal 88 such that a completed work piece 90 may be removed; the drawing indicates a hydraulic pivot drive means 92.

Figure 13:
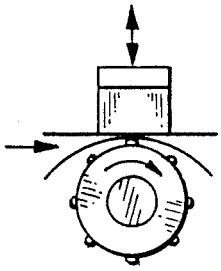
Figure 12:
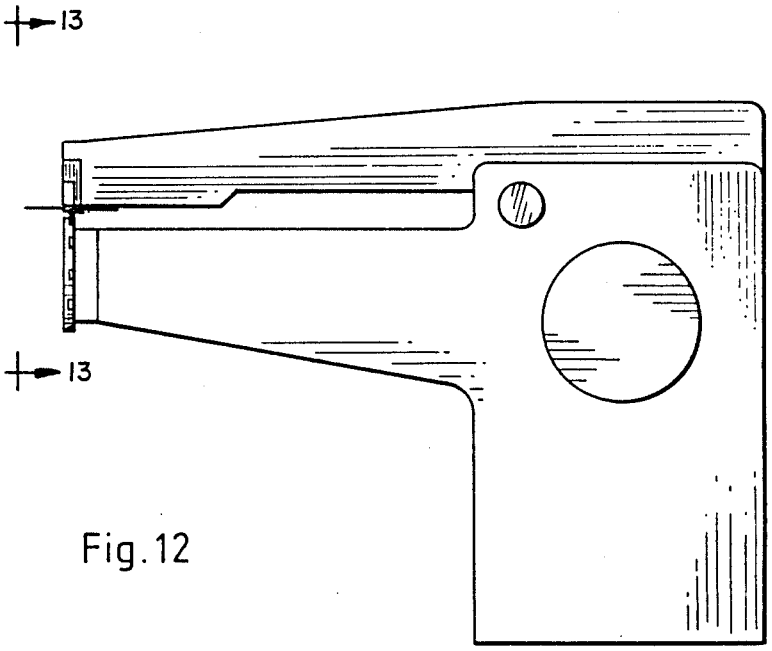
Figure 14:
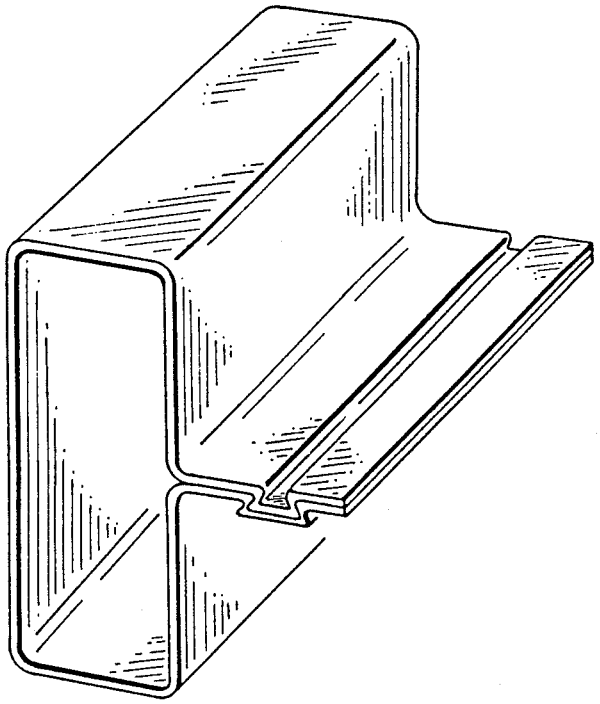
FIG. 14 shows a work piece resulting from the present invention.

FIGS. 12 and 13 show a similar machine comprised of two cantilevers. The feeding direction of the work piece, however, is orthogonal to the extension of the cantilevers permitting the joining of axially aligned tubes, or the joining of elongated flat work pieces as shown, for example, in FIG. 14.

It will be understood that similar to the embodiment illustrated in FIG. 10, revolving punch wheels may comprise a plurality of such wheels axially offset on a common shaft and each cooperating with its own set of a die and anvil. It should also be understood that the punches of the different wheels may operate in phase or in a phase lagged manner. For example, an installation for joining a flat sheet and a corrugated sheet to form a compound plate could comprise as many apparatuses as joint lines are to be made, and the joining would be implemented in one single operation.

It is by no means compulsory that punch and die cut through all the sheets to be joined. If the lateral dimension of the punch is less than the spacing between the die cutting edges, the sheet facing the punch will not be cut and the joint will be fluid-tight. If moreover the die is provided with rounded and therefore non-cutting edges, none of he sheets will be cut, and the joints will simply comprise deep drawn material portions in extruded interengagement.

It should also be understood that the apparatus may be mounted on a mobile device moved manually or automatically along guide means so join stationary sheets.

While particular embodiments of the apparatus for joining pieces of sheet metal have been described, it is to be understood that various modifications may be made thereto. The following claims are, therefore, intended to cover any such modifications within the true spirit and scope of the invention.

What is claimed is:

1. An apparatus for joining a plurality of overlapping pieces of sheet metal comprising:

(a) a punch member for engaging and drawing parts of the sheet metal material, (b) first and second work stations for treating the sheet metal material are mounted, (c) drive means for driving said punch member through said first and second stations, (d) said first station including a die member defining a cavity engaging said punch to draw the sheet metal material into said cavity, (e) said second station including an anvil member positioned to cooperate with said punch member to laterally extrude the drawn material positioned between said punch and anvil, (f) said drive means driving said punch member along a path to produce a first force component in a direction required for drawing and extruding the sheet metal material and a second force component substantially orthogonal to said first component to transport the overlapping sheet metal pieces from said first station to said second station.

2. An apparatus as set forth in claim 1 wherein said anvil member has a convex working face.

3. An apparatus as set forth in claim 1 wherein at least one of said die and anvil members is made of carbide metal.

4. An apparatus as set forth in claim 1 wherein said anvil member has lateral stops preventing extrusion of sheet metal adjacent said anvil member but permitting extrusion of sheet metal adjacent said punch member.

5. An apparatus as set forth in claim 1 wherein said punch member and said die member have cooperating cutting edges for cutting through at least one of said pieces in said first station.

6. An apparatus as set forth in claim 1 wherein said punch and die members, draw and deform said pieces without cutting.

7. An apparatus as set forth in claim 1 wherein said drive means drive said punch member along a closed loop path.

8. An apparatus as set forth in claim 7 wherein said path is circular.

9. An apparatus as set forth in claim 8 including a plurality of punch members mounted on a journalled wheel, and wherein said wheel is rotated by said drive means.

10. An apparatus as set forth in claim 7 wherein said punch member is reciprocally driven in direction of said second component and wherein cam surfaces are provided to guide said punch member in direction of said first component.

11. An apparatus as set forth in claim 1 including a common support for said die member and said anvil member.

12. An apparatus as set forth in claim 11 wherein said die member is mounted to said common support so as to be stationary with respect thereto.

13. An apparatus as set forth in claim 11 wherein said die member is mounted so as to be displaceable relative to said common support in the direction of said second component.

14. An apparatus as set forth in claim 13 wherein said die member is pivotably mounted to said common support so that said die member is movable between a start position and a final position, said apparatus further including spring means for biasing said die member toward its start position.

15. An apparatus as set forth in claim 11 wherein said die has means defining a U-shaped channel positioned in the direction of said second component.

16. An apparatus as set forth in claim 15 wherein said anvil member has a width larger than the width of said U-shaped channel.

17. An apparatus as set forth in claim 15 wherein said U-shaped channel increases in width from the exterior toward the interior.

18. An apparatus as set forth in claim 11 wherein said anvil member is mounted to said common support so as to be stationary with respect thereto.

19. An apparatus as set forth in claim 11 wherein said anvil member is mounted so as to be displaceable relative to said common support in the direction of said second component.

20. An apparatus as set forth in claim 19 wherein said anvil member comprises a roller rotatably journalled in said common support.

21. An apparatus as set forth in claim 19 wherein said anvil member is mounted in said common support for pivotal movement between a start position and a final position, and including spring means for biasing said anvil member into said start position.

22. An apparatus as set forth in claim 11 including means for adjusting the position of said die member relative to that of said anvil member in direction of said first component.

23. An apparatus for joining a plurality of overlapping pieces of sheet metal material comprising:

(a) a plurality of punch members mounted on a journalled wheel for engaging and drawing parts of the sheet metal material, (b) one die member defining a cavity engaging said punch members respectively in a first station to draw the sheet metal material into said cavity, (c) one anvil member adjacent said die member cooperating with said punch members in a second station after further advancement of said punch members respectively to extrude the drawn material, (d) driving means for driving said punch members relative to said die member and said anvil member along a path which includes a first component in a direction required for said drawing and extruding of the sheet metal material substantially orthogonal to said first component to transport said plurality of overlapping pieces of sheet metal material from said first station to said second station.

24. An apparatus as set forth in claim 23 wherein a plurality of punch member carrying wheels is mounted on a common shaft, the punch members of each wheel cooperating with an individual set of die and anvil members.

25. An apparatus as set forth in claim 23 wherein said punch members are integrally formed with said wheel.

26. An apparatus as set forth in claim 25 wherein said wheel includes stiffening discs axially offset with respect to said punch members, the latter protruding radially beyond said discs.

27. An apparatus as set forth in claim 25 including a ring member resiliently supported by circumferential portions of said wheel and adapted to push off said sheet metal pieces from said punch members.

* * * * *

UNITED STATES PATENT AND TRADEMARK OFFICE

CERTIFICATE OF CORRECTION

PATENT NO. : 4,835,850

DATED : June 6, 1989

INVENTOR(S) : Gerd-Juergen Eckold; Hans Maass

It is certified that error appears in the above-identified patent and that said Letters Patent is hereby corrected as shown below:

Column 1, line 35, after "-prised", insert --of--.

Column 2, delete lines 44 and 45 and insert in place therefore --FIGS. 11, 12 and 13 illustrate embodiments of equipment incorporating the present invention; and--.

Column 3, line 55, after "sheet", delete the comma ",".

Column 4, line 48, replace "re" with --are--.

Column 5, line 33, after "so" insert --to--.

IN THE CLAIMS:

Col. 5, Claim 1, line 47, please delete "are mounted".

Col. 6, Claim 6, line 10, delete the comma ",".

UNITED STATES PATENT AND TRADEMARK OFFICE

CERTIFICATE OF CORRECTION

PATENT NO. : 4,835,850

DATED : June 6, 1989

INVENTOR(S) : Gerd-Juergen Eckold; Hans Maass

It is certified that error appears in the above-identified patent and that said Letters Patent is hereby corrected as shown below:

Col. 7, Claim 23, line 19, after "material" add --and a second component.--

Signed and Sealed this

Twenty-second Day of December, 1992

*Attest:*

DOUGLAS B. COMER

*Attesting Officer*

*Acting Commissioner of Patents and Trademarks*